United States Patent [19]

Bow et al.

[11] 3,973,621

[45] Aug. 10, 1976

[54] HEAT EXCHANGER

[75] Inventors: William James Bow, Morris Township, N.J.; Martin David Bernstein, Bronx, N.Y.

[73] Assignee: Foster Wheeler Energy Corporation, Livingston, N.J.

[22] Filed: Nov. 27, 1974

[21] Appl. No.: 527,773

[52] U.S. Cl. ..... 165/83

[51] Int. Cl.[2] ..... F28F 9/12; F28F 5/00

[58] Field of Search ..... 165/81, 82, 158 M, 158 F, 165/83

[56] References Cited

UNITED STATES PATENTS

| | | | |
|---|---|---|---|
| 1,855,552 | 4/1932 | Jacocks et al. | 165/82 |
| 2,152,266 | 3/1939 | McNeal | 165/83 |
| 2,859,948 | 11/1958 | Callard | 165/82 |
| 3,627,035 | 12/1971 | Astrup | 165/81 |

FOREIGN PATENTS OR APPLICATIONS

| | | | |
|---|---|---|---|
| 601,128 | 12/1959 | Italy | 165/83 |

*Primary Examiner*—Charles J. Myhre
*Assistant Examiner*—Theophil W. Streule, Jr.
*Attorney, Agent, or Firm*—Marvin A. Naigur; John E. Wilson

[57] ABSTRACT

A heat exchanger in which a plurality of tubes are supported by tube sheets within a shell having inlet and outlet heads connected to its ends. One of the heads and tube sheets are secured directly to one end of the shell while the other tube sheet and head form a floating head assembly which is connected to the other end of the shell by an expansion joint to permit relative movement between the head assembly and the shell. A first heat exchange fluid is passed into the inlet head and through the tubes before discharging from the outlet head, and a second heat exchange fluid is passed through the shell in a heat exchange relation to the first heat exchange fluid. A load is applied to the head assembly in the direction of the shell to preload the tubes in compression, and movements of the head assembly relative to the shell in excess of a predetermined amount are prevented.

17 Claims, 7 Drawing Figures

HEAT EXCHANGER

BACKGROUND OF THE INVENTION

This invention relates to a heat exchanger and, more particularly, to a heat exchanger in which a heat exchange medium is passed through a shell in a heat exchange relationship to another fluid passing through a plurality of tubes supported within the shell.

Heat exchangers incorporating a plurality of tubes supported within a shell are well known. In these arrangements the tubes are usually supported at their ends by tube sheets and heads are provided at each end of the shell for circulating a heat exchange medium through the tubes in a heat exchange relationship to another fluid passing through the shell.

In view of the fact that water is often utilized as the fluid passing through the tubes and steam is often passed through the shell in heat exchange relation to the water, the tubes must normally be constructed of a material, such as stainless steel, that is resistant to the corrosive materials often contained in the water, while the shell structure may be constructed of a less expensive material, such as carbon steel. Therefore, since these two materials have different expansion coefficients, it can be appreciated that relative movement occurs between the tubes and the shell during operation of the heat exchanger at its relatively high operating temperature. Another consideration in this regard is that the tubes and the shell are subjected to different temperatures since the respective heat exchange fluids which influence them are at different temperatures. As a result, the systems for mounting the tube sheets and the heads relative to the shell must be designed to accommodate this relative movement.

Further problems exist in the design of heat exchangers of the above type when relatively high hydrostatic pressure loading occurs in the heads, the tubes and on the tube sheets as a result of higher operating pressures used in certain heat exchangers. In particular, an excessive hydrostatic load can cause failure of the systems for mounting one or both of the heads to the shell, or excessive tensile loading on the tubes, resulting in slippage of the ends of the tubes from the tube sheet, or damage to shell expansion joint, or excessive bending forces applied to tube sheet.

It is, therefore, an object of the present invention to provide a heat exchanger of the above type which accomodates relative movement between the tubes and the shell while maintaining a sealed connection between the heads or head assemblies and the shell.

It is a further object of the present invention to provide a heat exchanger of the above type in which the tubes are preloaded in compression so that they may withstand greater tensile loads occurring in operation than would normally be possible.

It is a still further object of the present invention to provide a heat exchanger of the above type in which relative movement between the tube sheet and the shell in excess of a predetermined amount is prevented.

SUMMARY OF THE INVENTION

Toward the fulfillment of these and other objects, the heat exchanger of the present invention comprises a shell, a plurality of tubes extending within said shell, two tube sheets for receiving the respective end portions of said tubes and supporting said tubes in said shell, an inlet and outlet head located at the respective ends of said shell, means for securing one of said heads and tube sheet directly to said shell, means for securing the other tube sheet to said other head to form a floating head assembly, an expansion joint connecting said floating head assembly to said shell while permitting relative movement therebetween, means for preventing said relative movement in excess of a predetermined amount, means for applying a load to said head assembly in the direction of said shell to preload said tubes in compression, means for passing a first heat exchange fluid into said inlet head for passing through said tubes and discharging from said outlet head, and means for passing a second heat exchange fluid through said shell in a heat exchange relation to said first heat exchange fluid.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
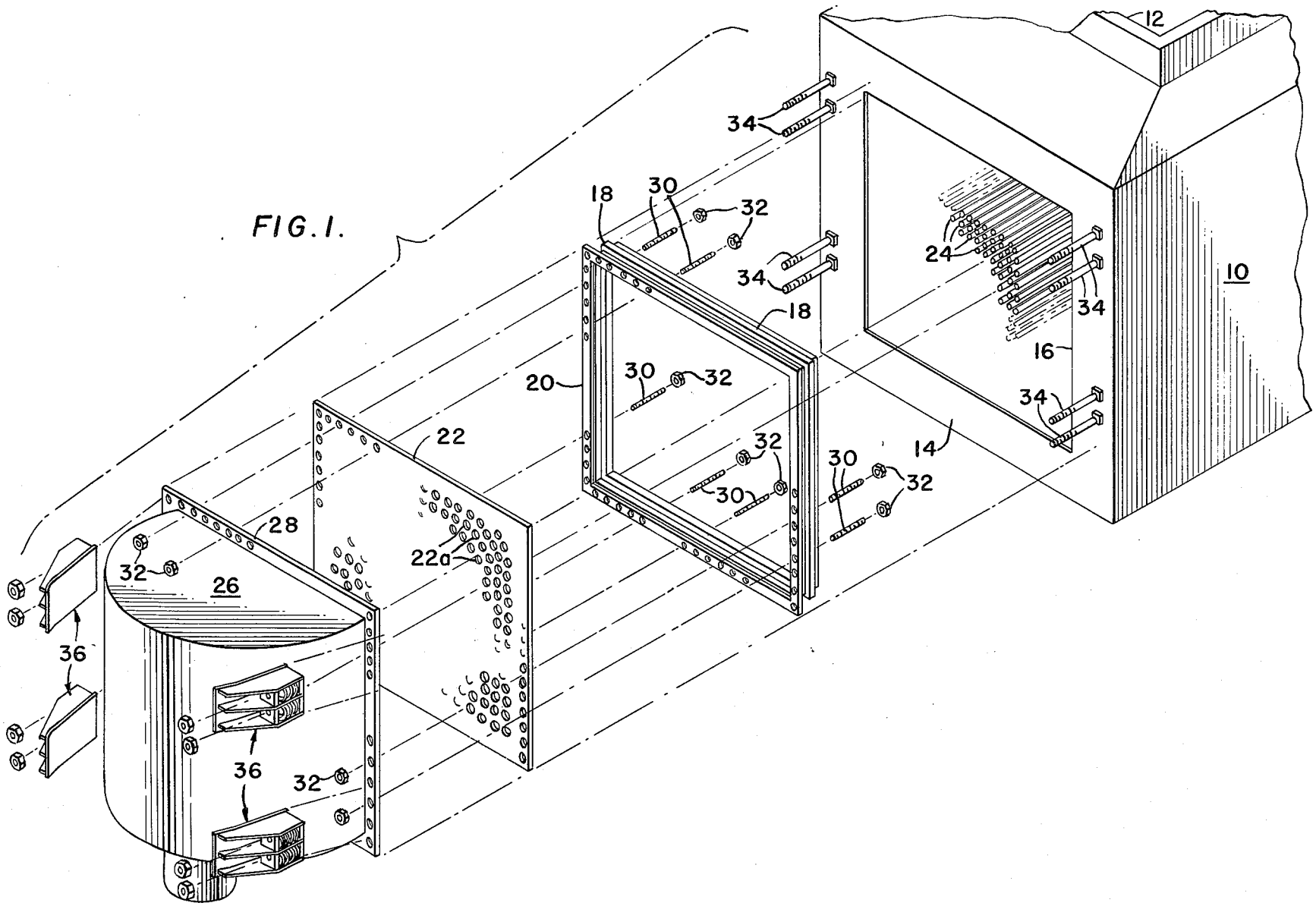
FIG. 1 is an exploded partial perspective view of a heat exchanger incorporating features of the present invention.

Referring specifically to FIG. 1 of the drawings, the reference numeral 10 refers in general to a portion of a vessel, or shell, having a flanged inlet 12 and a front face plate 14 defining a rectangular opening 16.

An expansion joint 18 and a support flange 20 are provided which are rectangular-shaped and which define an opening of a similar shape and size to the opening 16 in the face plate 14. A rectangular tube sheet 22 has a plurality of openings **22*a* formed therein for receiving the end portions of a bundle of tubes 24, with the remaining portions of the tubes extending within the shell 10. An inlet head, or water box, 26 which is provided with a suitable inlet connection 27, is designed for mounting relative to the shell flange 20 and has a mounting flange 28 extending around its outer periphery. A plurality of bolts 30 are used to extend through a series of aligned openings formed through the flange 20, the tube sheet 22 and the flange 28. The bolts 30 are threaded at each end and receive nuts 32 to secure the flange 20 and the tube sheet 22 to the water box 26** and form a head assembly.

Four pairs of tie-rods 34 project from the face plate 14 and extend through four corresponding mounting assemblies, shown in general by the reference numeral 36, for the purpose of applying a load to the above-mentioned head assembly, as will be described in detail later. It should be understood that any suitable number of tie-rods 34 can be used.

Figure 2:
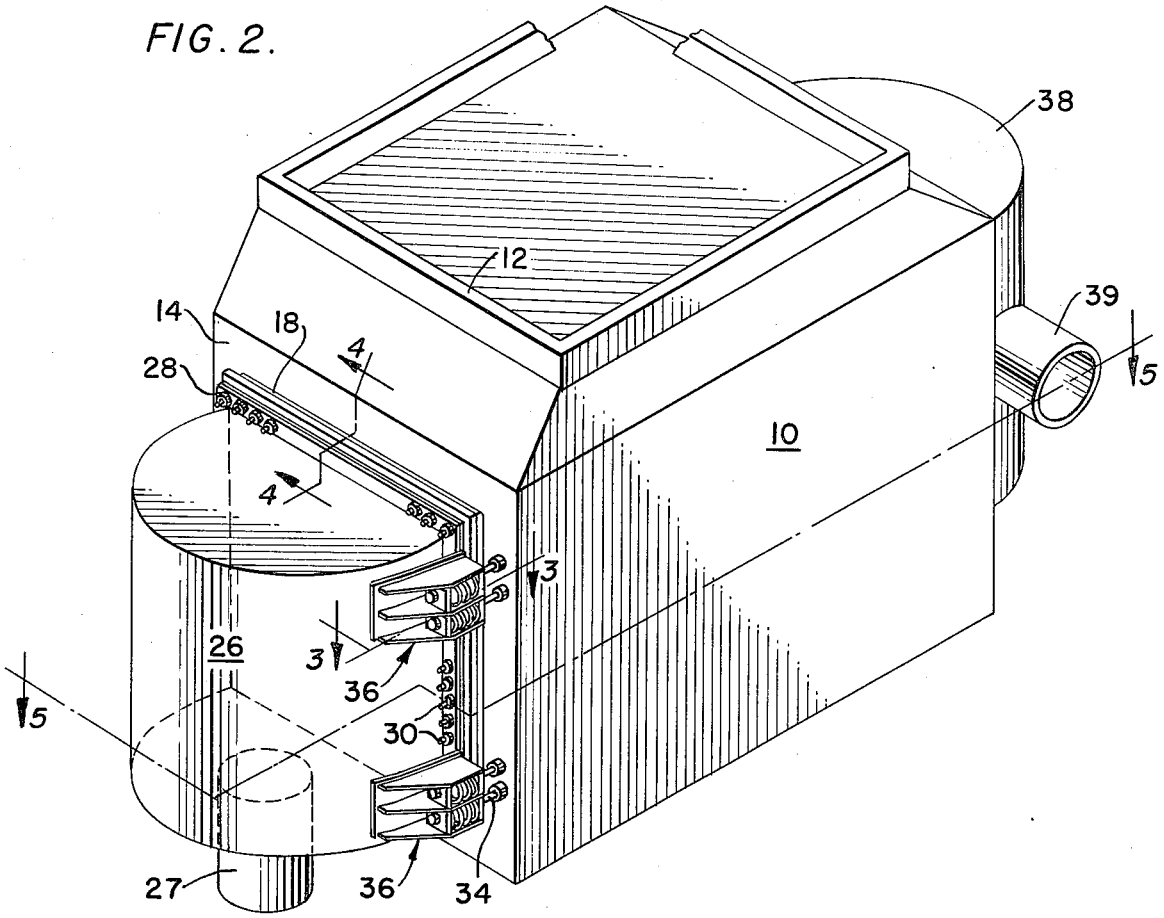
FIG. 2 is a perspective view depicting the heat exchanger of FIG. 1 in an assembled condition.

FIG. 2 depicts the components of FIG. 1 in an assembled condition and, in addition, shows an outlet head, or water box 38 which is provided with a suitable outlet connection 39, and head 38 is secured relative to a rear face plate of the shell 10 in a manner to be described in detail later.

Figure 3:
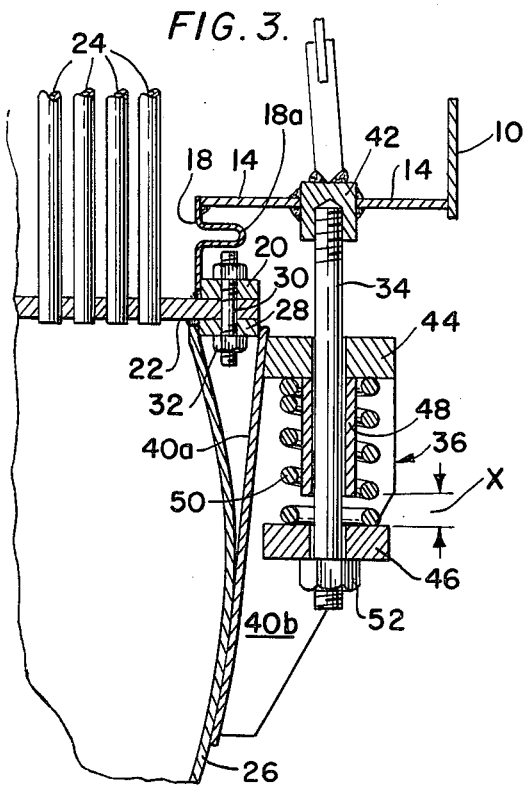
FIGS. 3–5 are enlarged cross-sectional views taken along the lines 3—3, 4—4, and 5—5, respectively, of FIG. 2.
Figure 4:
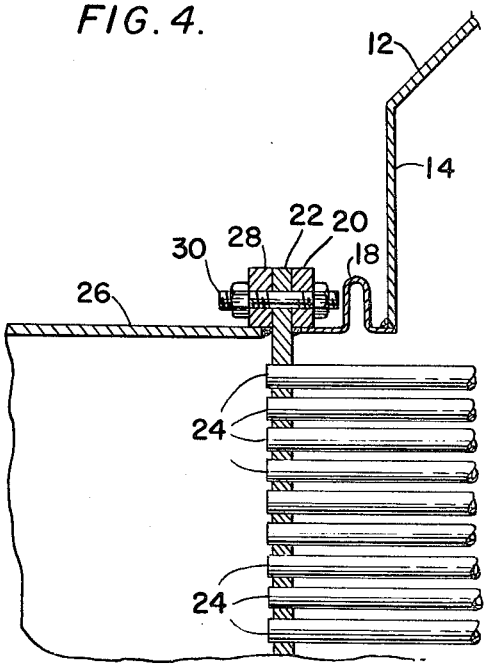

Referring in general to FIG. 2 and more specifically to FIGS. 3 and 4, the expansion joint 18 has a pleated portion 18*a* and is welded along one end to the inner surface of the face plate 14 defining the opening 16, and along its other end to the inner surface of the flange 20.

The mounting assemblies 36 are designed to mount the head assembly formed by the water box 26, the tube sheet 22 and the flange 20 to the shell 10 in a manner to permit relative movement between the tubes 24 and the shell 10, and to apply a compressive preload to the tubes. In particular, each mounting assembly 36 consists of a vertical plate 40*a* which is welded, or otherwise attached, to the outer periphery of the water box 26, and three horizontally disposed plates 40*b* which are welded, or otherwise attached, to the plate 40*a*. One end portion of each tie-rod 34 is in threaded engagement with a stud block 42 extending through, and secured relative to, the shell face plate 14. The tie-rods 34 extend through corresponding spaces defined between the adjacent horizontal plates 40*b*, with one tie-rod and its associated components being shown and described in detail in connection with FIG. 3. In particular, a plate member 44 is welded, or otherwise attached, to the plates 40*a* and 40*b* and has a central opening for receiving the tie-rod 34. A washer 46 extends over the free end portion of the tie-rod 34, and a spacer sleeve 48 extends between the plate member 44 and the washer and is surrounded by a spring 50. It is noted that one end of the spacer sleeve 48 normally butts against the plate member 44 and the other end is spaced a predetermined distance from the washer 46, as shown by the reference letter X, for reasons to be described in detail later. The free end portion of the tie-rod 34 is threaded and receives a nut 52 which engages the washer 46. It is understood that the remaining tie-rods 34 and their associated components are constructed and located in an identical manner.

Figure 5:
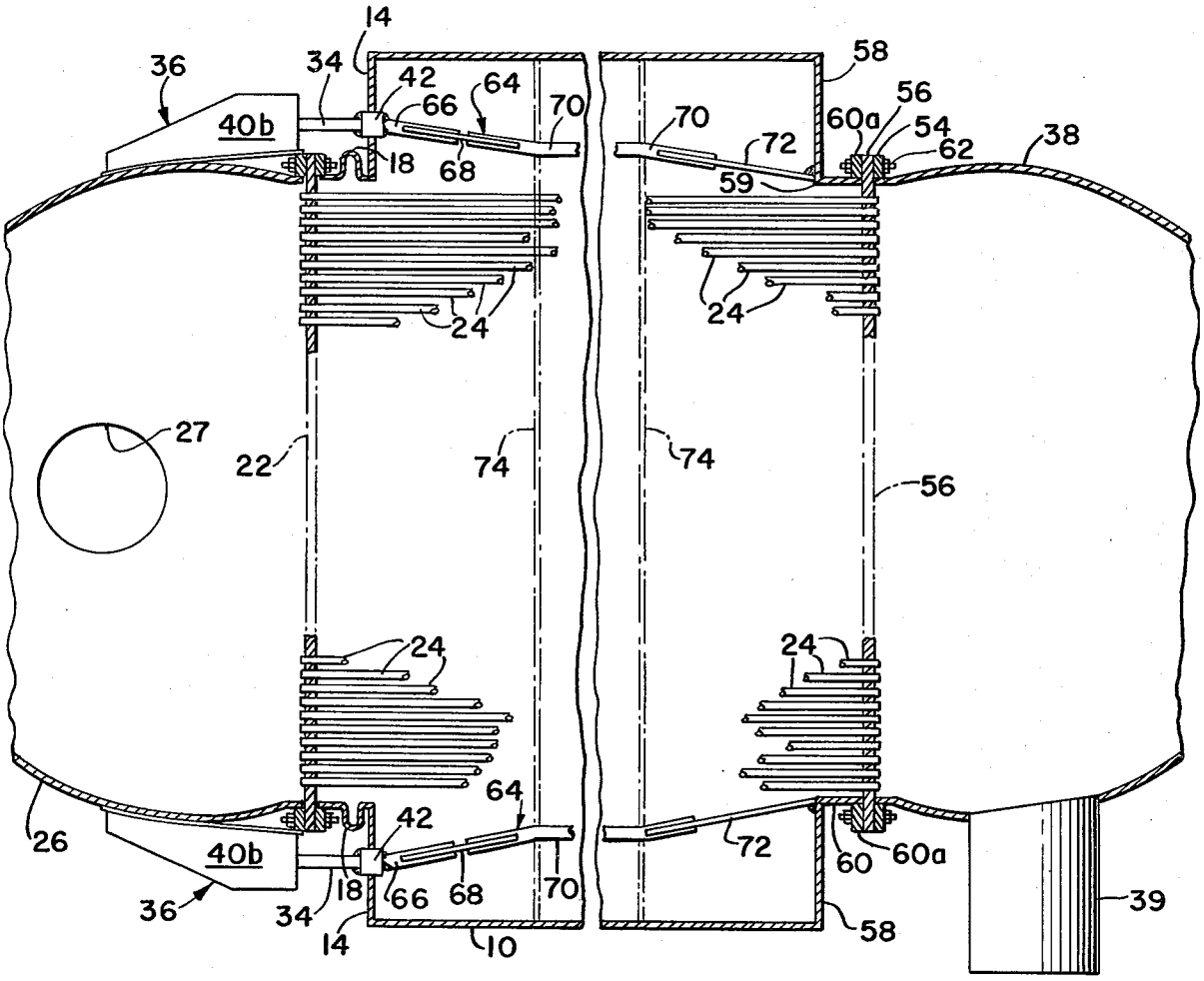
Figure 6:
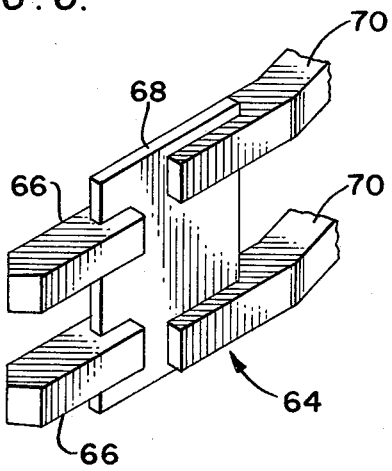
FIGS. 6 and 7 are enlarged partial perspective views of the upper tie-bar assembly shown in FIG. 5.

The details of the water box 38 and its connection to the shell 10 are shown in FIG. 5. In particular, a flange 54 is provided around the outer periphery of the water box 38 at its open end and is disposed adjacent a tube sheet 56 which supports the other end portions of the tubes 24. A rear face plate 58 is provided on the rear end of the shell 10 and defines a rectangular opening 59 identical in size to the opening 16 defined by the front face plate 14. A neck portion 60 extends outwardly from the face plate 58 and is provided with a flange 60*a* around its outer periphery. A plurality of bolts 62 extend through a series of aligned openings formed through the flange 54, the tube sheet 56, and the flange 60*a*, with each bolt being adapted to receive a nut at both ends to rigidly secure the water box 38, the tube sheet 56 and, therefore, the corresponding ends of the tubes 24 relative to the shell 10.

Figure 7:
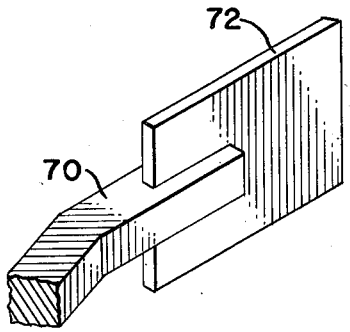

A tie-bar assembly, shown in general by the reference numeral 64, is fastened to the other end of each stud block 42, extends through substantially the entire length of the shell 10, and is attached to the inner surface of the rear face plate 58 to carry the load on the tie-rods 34 throughout this distance. Each tie-bar assembly 64 comprises a pair of bars 66 connected at one of their ends to their respective stud blocks 42 and secured at their other ends thereof to a plate 68 by welding or the like. An additional pair of bars 70 are also fastened to the plate 68, and are spaced apart a greater vertical distance than the bars 66 in order to distribute the load on the tie-bar assembly 64 in a vertical plane. The bars 70 extend for a substantial portion of the remaining length of the shell 10 and each bar is fastened to a separate plate 72 in the same manner as described above, and as shown in FIG. 7. The plate 72 is welded, or otherwise attached, to the rear surface of the rear face plate 56 of the shell.

The reference numerals 74 refer in general to a pair of tube support plates which extend across the shell 10 and which have openings formed therein for receiving the tubes 24 and the bars 70. It is understood that the tie-rod assembly 64 can be further supported in a lateral plane by suitable bracing or the like as needed.

The tie-bar assembly 64 thus carries the tensile load applied to the tie-rods 34 over a relatively long horizontal distance and distributes the tensile load in a vertical plane to provide a relatively uniform distribution of loading on the bolting at this end of the shell 10.

As a result, a heat exchange fluid, such as water, is introduced into the water box 26 via the inlet connection 27 and passes through the tubes 24 for the length of the shell 10, after which it collects in the water box 38 and discharges from the outlet 39. It is also understood that an additional heat exchange fluid, such as steam, is passed into the shell 10 through the opening 12, whereby it passes in a heat exchange relation to the fluid passing through the tubes 24 before condensing and exiting through a suitable outlet formed through the shell bottom.

In operation, and before the heat exchange fluids are admitted into the heat exchanger, the nuts 52 are advanced along their respective tie-rods 34 in a direction toward the shell 10 to compress, or load, the springs 50 and move the floating head assembly, consisting of the water box 26, the tube sheet 22 and the flange 20, towards the shell 10. This applies a predetermined compressive load to the tubes 24, and a corresponding tensile load to the tie-rods 34 which is carried through the length of the shell by the tie-bar assembly 64. By progressively inspecting FIGS. 3 and 5, it can be appreciated that the tensile load carried by the tie-bar assembly 64 is opposed by the above-mentioned compressive load developed in the tubes 24.

Upon admission of the heat exchange fluids into the water box 26 and the shell 10, the temperature within the shell will be raised to a relatively high level. Since the tubes and the shell are subjected to different average temperatures and have different coefficients of expansion, the tubes will expand or contract to a greater extent than the shell, with the resulting movement being accommodated by a corresponding movement of the head assembly inwardly or outwardly from the shell 10 and a resultant expansion or compression of the joint 18 and expansion or compression of the spring 46. This movement will also cause the sleeve 48 to move relative to the washer 46 with the design being such that after movement of the sleeve over the distance X, as shown in FIG. 3, it will contact the washer and prevent further outward movement of the head assembly. This provides a fail-safe retention of the head assembly relative to the shell despite possible failures in the various connections and/or release of one or more tubes 24 from the tube sheet caused, for example, by tube erosion or corrosion or hydrostatic pressure building up in the water boxes in excess of design limits.

It is thus seen that, according to the present invention, relative movement between the tubes and the shell is permitted while a sealed connection is maintained between the heads and the shell. Also, the above relative movement is kept within design limits to provide a fail-safe protection against failure of one or more components of the heat exchanger. Further, relatively high hydrostatic pressures can be accommodated by virtue of the high tensile stresses that can be withstood by the tubes as a result of their compressive preloading. In a similar fashion, greater structural duty than would otherwise be possible is obtained from the tube sheet, also by virtue of the preloading technique.

Of course, variations of the specific construction and arrangement of the heat exchanger disclosed above can be made by those skilled in the art without departing from the invention as defined in the appended claims.

What is claimed is:

1. A heat exchanger comprising a shell member, a pair of tube support members located at the respective end portions of said shell member, a plurality of tubes disposed within said shell and secured at their respective end portions to said tube support members, expansion means connecting one of said tube support members to said shell member while permitting relative movement therebetween, means cooperating with at least one of said members for applying a compressive preload to said tubes, means for passing a first heat exchange fluid through said tubes, and means for passing a second heat exchange fluid through said shell member in a heat exchange relation to said first heat exchange fluid.

2. The heat exchanger of claim 1, wherein the other of said tube support members is secured to said shell and wherein said means for applying a compressive preload to said tubes is adapted to apply a load against said one tube support member in the direction of said other tube support member.

3. The heat exchanger of claim 2, wherein said means for passing a first heat exchange fluid through said tubes comprises a water box secured to each of said tube support members and having openings extending therethrough for the passage of said first heat exchange fluid.

4. The heat exchanger of claim 3, wherein one of said water boxes is adapted to receive said first heat exchange fluid from an external source before it passes through said tubes and the other of said water boxes is adapted to discharge said first heat exchange fluid after it passes through said tubes.

5. The heat exchanger of claim 3, wherein said means for applying said load comprises a rod connected to said shell, moveable means affixed to the water box associated with said one tube support member and mounted on said rod for movement relative thereto, and means supported by said rod for forcing said moveable means and therefore said one tube support member towards said other tube support member.

6. The heat exchanger of claim 5, wherein said means for forcing said moveable means comprises a spring extending over said rod and a nut threadedly engaging said rod and abutting said spring, whereby axial adjustment of said nut on said rod moves said water box of said one tube support member and therefore said one tube support member relative to said other tube support member.

7. The heat exchanger of claim 6, wherein said relative movement is caused by expansion and contraction of said tubes relative to said shell member, said expansion being accommodated by deflection of said spring and movement of said expansion joint.

8. The heat exchanger of claim 5, further comprising means for carrying said load along a distance corresponding to the length of said shell.

9. The heat exchanger of claim 5, wherein said means for carrying said preload comprises at least one tie bar means extending for substantially the entire length of said shell member and secured at each end to said shell member, said rod being connected to said tie bar through said shell member to apply said load to said tie bar.

10. The heat exchanger of claim 9, wherein axial movement of said nut on said rod in a direction towards said other support member applies a compressive load to said tubes and tensile load to said rod and said tie bar means.

11. The heat exchanger of claim 1, further comprising stop means for preventing said relative movement between said tube support member and said shell member in excess of a predetermined amount.

12. The heat exchanger of claim 2, wherein said load against said one tube support member preloads said one tube support member to increase the load carrying capability of said one tube support member.

13. A heat exchanger comprising a shell member, a pair of tube support members located at the respective end portions of said shell member, a plurality of tubes disposed within said shell and secured at their respective end portions to said tube support members, expansion means connecting at least one of said tube support members to said shell member while permitting relative movement therebetween, means cooperating with at least one of said members for limiting the amount of said relative movement, means for passing a first heat exchange fluid through said tubes, and means for passing a second heat exchange fluid through said shell member in a heat exchange relation to said first heat exchange fluid.

14. The heat exchanger of claim 13, further comprising means for securing one of said tube support members to said shell member, said expansion means connecting the other of said tube support members to said shell member.

15. The heat exchanger of claim 14, wherein said relative movement is in the form of movement of said other tube support member outwardly relative to said shell member.

16. The heat exchanger of claim 15, wherein said means for limiting the amount of said relative movement comprises a pair of rigid elements respectively connected to said other tube support member and said shell member and adapted to engage each other after a predetermined amount of said relative movement.

17. The heat exchanger of claim 14, wherein said means for limiting said movement comprises a rod secured to said shell member, a sleeve slidably mounted over said rod for movement relative thereto in response to movement of said other tube support member outwardly relative to said shell member, and abutment means disposed on said rod for limiting the amount of said movement of said sleeve.

* * * * *